US008926017B2

(12) United States Patent
Grove et al.

(10) Patent No.: US 8,926,017 B2
(45) Date of Patent: Jan. 6, 2015

(54) CHAIR WITH INTEGRAL PIVOTING LUMBAR AND SEAT CUSHION PORTIONS

(76) Inventors: James E. Grove, Marina Del Rey, CA (US); Dennis J. Colonello, Beverly Hills, CA (US)

( * ) Notice: Subject to any disclaimer, the term of this patent is extended or adjusted under 35 U.S.C. 154(b) by 37 days.

(21) Appl. No.: 13/604,871

(22) Filed: Sep. 6, 2012

(65) Prior Publication Data

US 2014/0062153 A1 Mar. 6, 2014

(51) Int. Cl.
*A47C 1/032* (2006.01)

(52) U.S. Cl.
USPC ..... 297/325; 297/300.2; 297/284.1

(58) Field of Classification Search
USPC ..... 297/325, 316, 302.1, 300.2, 284.4, 297/284.1, 123
See application file for complete search history.

(56) References Cited

U.S. PATENT DOCUMENTS

| | | | | | |
|---|---|---|---|---|---|
| 233,140 | A | | 10/1880 | Candrian | |
| 2,398,072 | A | * | 4/1946 | Boerner | 297/301.4 |
| 3,042,448 | A | * | 7/1962 | Hamilton | 297/300.5 |
| 3,134,627 | A | * | 5/1964 | Mason | 297/411.27 |
| 3,185,429 | A | * | 5/1965 | Meinhardt | 248/575 |
| 3,223,376 | A | * | 12/1965 | Ciuffini et al. | 248/417 |
| 4,157,203 | A | | 6/1979 | Ambasz | |
| 4,200,332 | A | * | 4/1980 | Brauning | 297/300.3 |
| 4,834,453 | A | | 5/1989 | Makiol | |
| 5,261,723 | A | | 11/1993 | Hosoe | |
| 5,383,712 | A | | 1/1995 | Perry | |
| 5,501,507 | A | | 3/1996 | Hummitzsch | |
| 5,630,647 | A | * | 5/1997 | Heidmann et al. | 297/303.3 |
| 5,758,924 | A | * | 6/1998 | Vishey | 297/284.4 |
| 6,056,361 | A | | 5/2000 | Cvek | |
| 6,386,634 | B1 | * | 5/2002 | Stumpf et al. | 297/300.4 |
| 6,412,869 | B1 | | 7/2002 | Pearce | |
| 6,669,294 | B2 | | 12/2003 | Kinoshita et al. | |
| 2002/0043841 | A1 | * | 4/2002 | Giacinto | 297/284.4 |
| 2004/0046432 | A1 | * | 3/2004 | Ball et al. | 297/284.4 |
| 2005/0225140 | A1 | * | 10/2005 | Kneeshaw | 297/284.4 |
| 2008/0001452 | A1 | * | 1/2008 | Schmitz et al. | 297/284.6 |
| 2008/0007102 | A1 | * | 1/2008 | Dahlbacka et al. | 297/284.4 |
| 2011/0233979 | A1 | * | 9/2011 | An | 297/284.4 |

* cited by examiner

*Primary Examiner* — Jeanette E. Chapman
(74) *Attorney, Agent, or Firm* — Morland C. Fischer

(57) ABSTRACT

A chair of the type commonly found in a home or office and having a stationary back, a pair of arms, and a rotatable seat cradle that is located between the arms. The seat cradle includes a lumbar portion lying against the stationary chair back to support the user's lower back and a seat cushion portion to support the user's pelvis. The lumbar portion and the seat cushion portion of the seat cradle are connected to one another so as to rotate together as a unit relative to the stationary back and the arms of the chair. By virtue of the foregoing, the hips and spine of the user will be continuously aligned whenever the user shifts his weight in the chair, whereby to maximize user comfort and improve user posture.

23 Claims, 5 Drawing Sheets

CHAIR WITH INTEGRAL PIVOTING LUMBAR AND SEAT CUSHION PORTIONS

BACKGROUND OF THE INVENTION

1. Field of the Invention

This invention relates to a home or office chair having an upstanding stationary back and a seat cradle that is rotatable relative to the back as a user shifts his weight in the chair. The cradle includes the integral connection of a lumbar portion which supports the lower back of the user and a seat cushion portion which supports the pelvis of the user.

2. Background Art

Chairs of the kind found in an office or at home typically have an upstanding back and a horizontal seat which is fixedly connected to and extends outwardly from the back. The back and seat of the conventional chair support the user's hips and spine when the user leans back and remains at rest. However, should the user rock in the chair and shift his weight forward, his spine will often be out of alignment with his hips. Because of the generally rigid nature and integral connection of the back and seat, the conventional chair is often not adapted to provide adequate support to the user's back and ensure a proper alignment of his spine and hips in response to the user shifting his weight forward. Consequently, the user's posture might be negatively impacted which could result in discomfort should the user lean forward in his chair for a long time.

Accordingly, what is desirable is an improved chair having a stationary back and a seat cradle that is rotatable relative to the back so as to provide continuous support so as to hold the user's hips and spine in proper alignment and preserve the user's posture regardless of his position in the chair.

SUMMARY OF THE INVENTION

In general terms, a chair is disclosed of the kind commonly found in a home or office. The chair includes an upstanding stationary back, a seat, a pair of arms, and an adjustable base to hold the back, seat and arms off the ground. The seat of the chair is a rotatable seat cradle that is adapted to rotate relative to the back, arms and base. The cradle has a lumbar portion at one end thereof to support the lower back of one seated in the chair. A seat cushion portion is located at the opposite end of the cradle to support the user's pelvis. The lumbar and seat cushion portions of the cradle are integrally connected to one another so as to rotate together as a unit. A depression is formed in the back of the chair in which to receive the lumbar portion of the cradle. The lumbar portion moves into and out of the depression as the cradle rotates relative to the chair back.

According to a first preferred chair embodiment, a bracket is attached across the top of the chair base. A pair of seat couplers which extend downwardly from the bottom of the seat cushion portion of the seat cradle are pivotally connected to the bracket. In particular, pivots extend between respective ones of the pair of seat couplers and the bracket. Accordingly, when the user shifts his weight forward and back in the chair, the cradle will correspondingly rotate relative to the stationary chair back in first and opposite directions around the pivots. Thus, the user's spine and hips will stay aligned to maintain a proper positive posture regardless of the user's position in the chair.

According to a second preferred chair embodiment, a pivot support brace is connected across each of the chair arms. Pivots extend between the pivot support brace of each chair arm and an opposing wall that stands upwardly from the seat cradle between the lumbar and seat cushion portions thereof.

A bracket is attached across the top of the chair base. A spring housing is carried by the bracket so as to lie below the cradle. A spring member is enclosed by the spring housing. In one example, the spring member is a resilient cradle restoration block. In another example, the spring member is first and second coil springs that are axially aligned with one another. First and second stationary posts are connected to first and opposite ends of the spring member. A centering rod extends from the rotatable cradle to the spring member between the first and opposite ends thereof. When the user shifts his weight forward in the chair, the seat cradle will rotate in a first direction around the pivots away from the stationary chair back such that the centering rod moves within the spring housing to cause the spring member to be compressed and store energy. When the user shifts his weight back and the cradle rotates in an opposite direction, the spring member will expand and release its stored energy. The centering rod correspondingly moves within the spring housing to cause the cradle to rotate towards the chair back and return to its initial centered position.

DESCRIPTION OF THE PREFERRED EMBODIMENT

Details for a chair 1 having integral pivoting lumbar and seat cushion portions according to a first preferred embodiment of this invention are described while referring concurrently to FIGS. 1-4 of the drawings. The chair 1 is of the type that would be commonly found in a home or office. As will be described in greater detail hereinafter, the chair improves the posture of a seated individual by enabling the hips and spine to align as the user rocks and shifts his weight forward and back, whereby to maximize user comfort. However, the advantages of this invention are applicable to other chairs including, but no limited to, automobile chairs, wheel chairs, stadium or theater chairs, and chairs found in aircraft.

Figure 1:
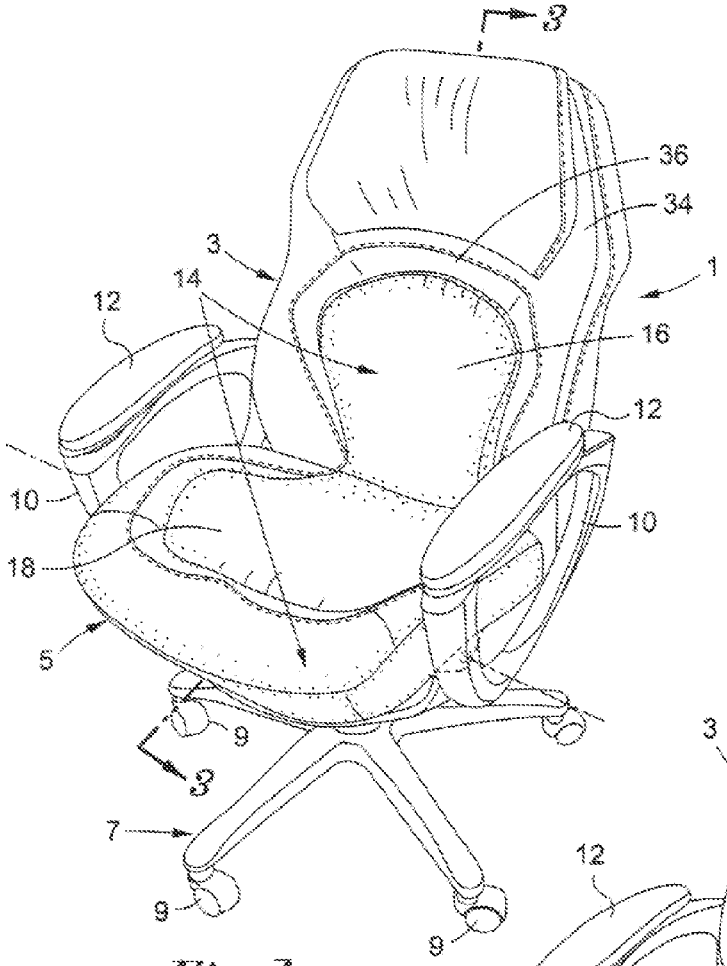
FIGS. 1 and 2 are perspective views of a chair having a seat cradle including pivoting lumbar and seat cushion portions according to a first preferred embodiment of this invention.
Figure 2:
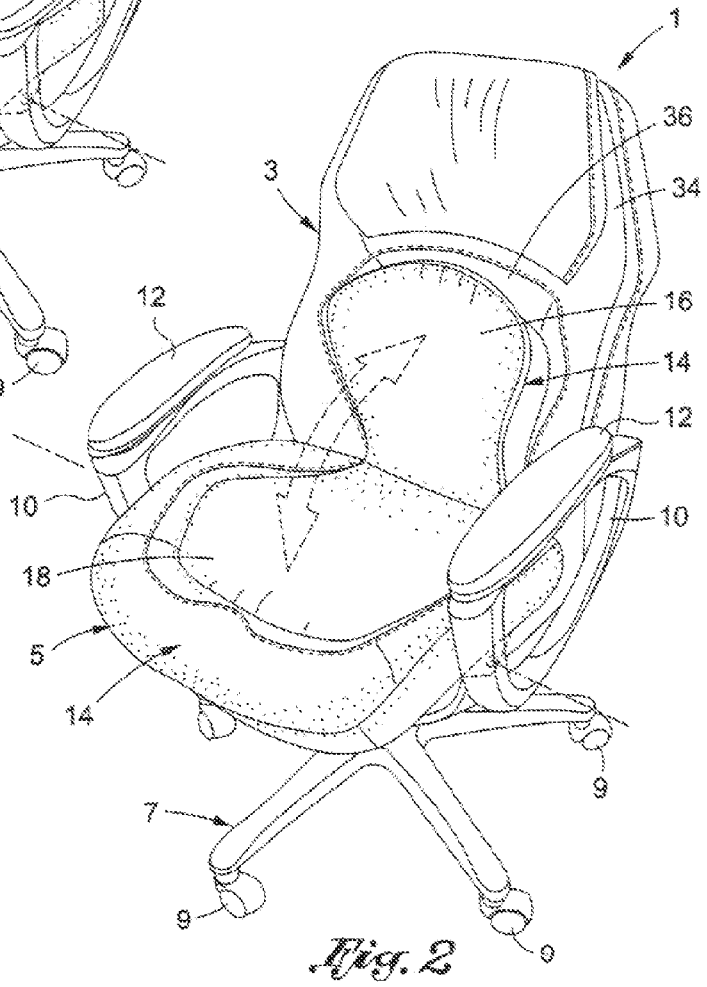

As is best shown in FIGS. 1 and 2, the chair 1 includes a back 3 against which the user's back is rested, a seat 5 to support the user's pelvis, and a base 7 to elevate the back 3 and seat 5 above the ground. The base 7 includes a set of rollers 9 to enable the chair 1 to be moved from place-to-place. The base 7 also includes a conventional gas lift which enables the height and tilt of the seat 5 to be adjusted. However, the advantages of this invention are applicable to chairs with a base other than that shown in FIGS. 1 and 2, including chairs with legs or with no base at all. Thus, the base 7 of the chair 1 shown in FIGS. 1 and 2 is not to be regarded as a limitation of this invention.

A pair of arms 10 are located at opposite sides of the chair 1. Each arm 10 is connected to the chair back 3 and to a bracket (designated 24 in FIG. 3) that is mounted atop the chair base 7. A cushion arm pad 12 is attached to each of the arms 10 to receive and support the arms of the user. Like the base 7, the particular arms of the chair 1 should not be regarded as a limitation of this invention.

As an important detail of this embodiment, the seat 5 of the chair 1 is a rotatable seat cradle 14 within which to receive and reposition the user's lower back and pelvis. The rotatable cradle 14 includes a lumbar portion 16 and a seat cushion portion 18 that are aligned generally perpendicular to one another. The lumbar and seat cushion portions 16 and 18 are integrally connected so as to rotate together as a unit through a vertical plane in the directions of the reference arrows of FIG. 2 in response to the user shifting his weight in the chair 1 and rocking in the cradle 14.

Figure 3:
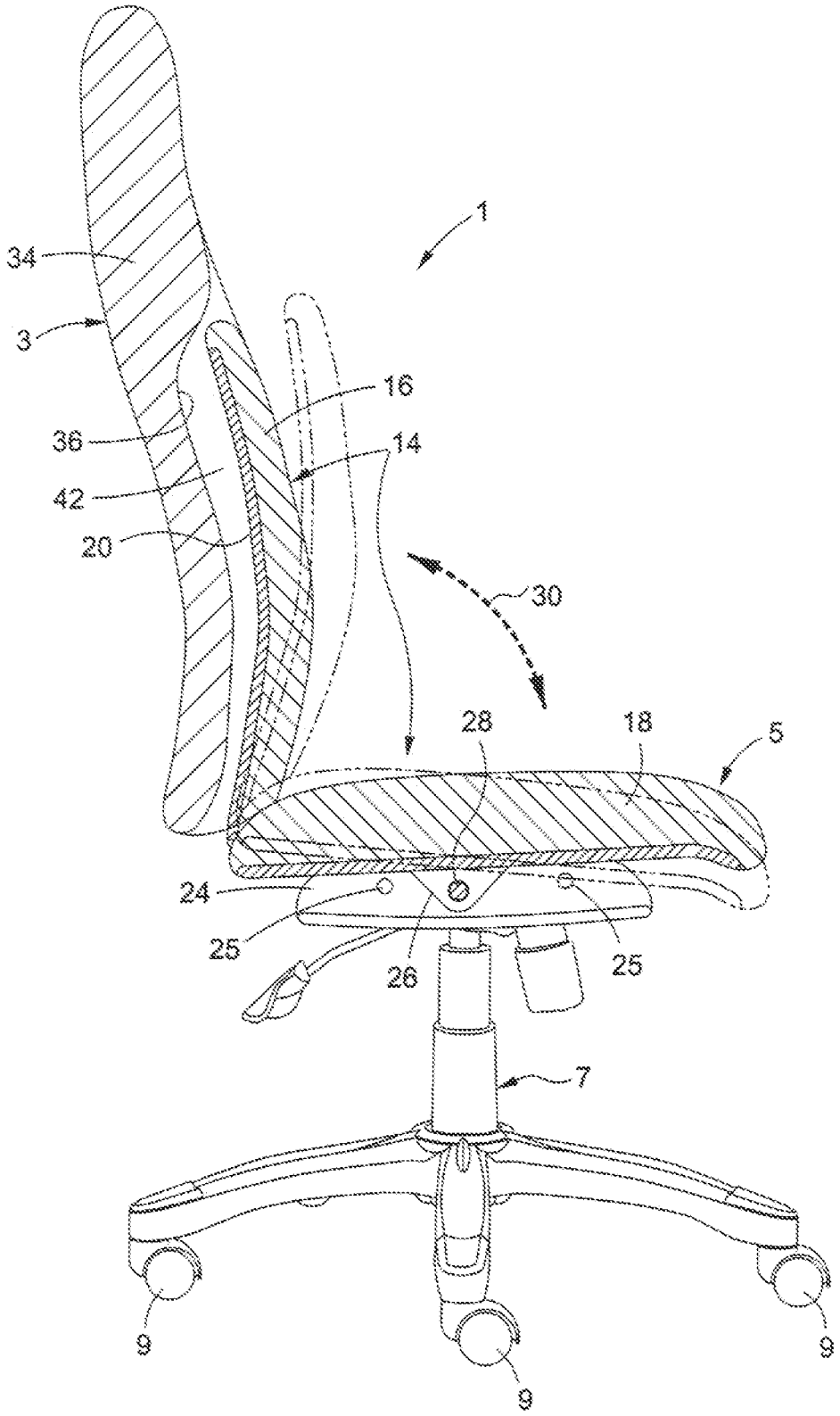
FIG. 3 is a cross-section of the chair taken along lines 3-3 of FIG. 1.

Referring particularly to FIG. 3 of the drawings, each of the lumbar portion 16 and the seat cushion portion 18 of the rotatable seat cradle 14 is attached (e.g., adhesively bonded) to a rigid (e.g., plywood) backing 20. The backing 20 may be a single continuous piece (as shown) that is bent to conform to the shape of the lumbar and seat cushion portions 16 and 18 or separate pieces that are joined to one another.

A (e.g., steel) bracket 24 is fixedly mounted across the top of the base 7 so as to lie below the seat cradle 14 of the chair 1. Each of the chair arms (10 in FIGS. 1 and 2) is connected to the bracket 24 at mounting holes 25 formed therein. A pair of seat couplers 26 (only one of which being shown) are connected to and project downwardly from the backing 20 which runs below the seat cushion portion 18 of cradle 14. Each seat coupler 26 is pivotally connected to the bracket 24. That is, a pin or a similar pivot 28 extends through the bracket 24 and each coupler 26 to establish pivot axes and thereby enable the cradle 14 to rotate back and forth in the directions of the reference arrows 30 of FIG. 3. Thus, it may be appreciated that the rotatable cradle 14 is connected in the chair 1 solely by means of the pivotal connection of the seat couplers 26 to the bracket 24. In this same regard, it may be further appreciated that the cradle 14 is rotatable relative to the back 3, the arms 10 and the base 7 of the chair 1.

Referring once again to FIGS. 1-3, the back 3 of the chair 1 includes a stationary upstanding back support 34 that extends in a generally vertical direction. A front-facing depression or recess 36 is formed in the back support 34 along approximately the bottom half thereof. The depression 36 is sized and shaped to receive the lumbar portion 36 of the cradle 14 therewithin when the chair 1 is empty or when a user who is seated in the chair leans back and remains at rest.

When a user is seated in the chair 1 with his weight evenly distributed on opposite sides of the pivots 28 (of FIG. 3), the rotatable seat cradle 14 will be at rest. In this case, the lumbar portion 16 of the cradle 14 is received within the depression 36 so as to lie against the back support 34 of the chair back 3. The seat cushion portion 18 of the cradle 14 extends horizontally and outwardly from the lumbar portion 18 of cradle 14.

Should the user rock in the chair 1 and shift his weight forward of the pivots 28 (of FIG. 3), both the lumbar and seat cushion portions 16 and 18 of the seat cradle 14 will simultaneously rotate in a first direction around the pivots 28. In this case, the lumbar portion 16 rotates away from the back support 34 and out of the depression 36 formed in the back support 34, such that a gap 42 (best shown in FIG. 3) is established between the lumber portion 16 and the back support 34. It may be appreciated that the back support 34 of the chair back 3 remains erect and stationary, such that the lumbar portion 16 of cradle 14 rotates relative to the back support.

At the same time, the seat cushion portion 18 of the cradle 14 which is integrally connected to the lumbar portion 16 rotates downwardly in the first direction around the pivots 28. It may be further appreciated that the seat cushion portion 18 also rotates relative to the stationary back support 34 of the chair back 3.

The positions of the lumbar and seat cushion portions 16 and 18 following the rotation of the seat cradle 14 in the first direction are shown in phantom lines in FIG. 3. When the user rocks backwards and shifts his weight behind the pivots 28 (of FIG. 3), the cradle 14 will correspondingly rotate in an opposite direction so as to return to its initial position shown in FIGS. 1 and 2. In this case, the lumbar portion 16 of cradle 14 will rotate back into the depression 36 formed in the back support 34 of the chair back 3.

By virtue of the simultaneously rotating and integrally connected lumbar and seat cushion portions 16 and 18 of the rotatable seat cradle 14, the users pelvis is rotated so that his spine is continuously held in a neutral centered position while lower back support is provided regardless of the user's position in the chair 1 as he rocks back and forth. Hence, the user's posture is improved to promote user comfort. In this same regard, the user is also provided with the option of exercising his abdomen and lower back muscles by rocking back and forth in the chair.

Figure 4:
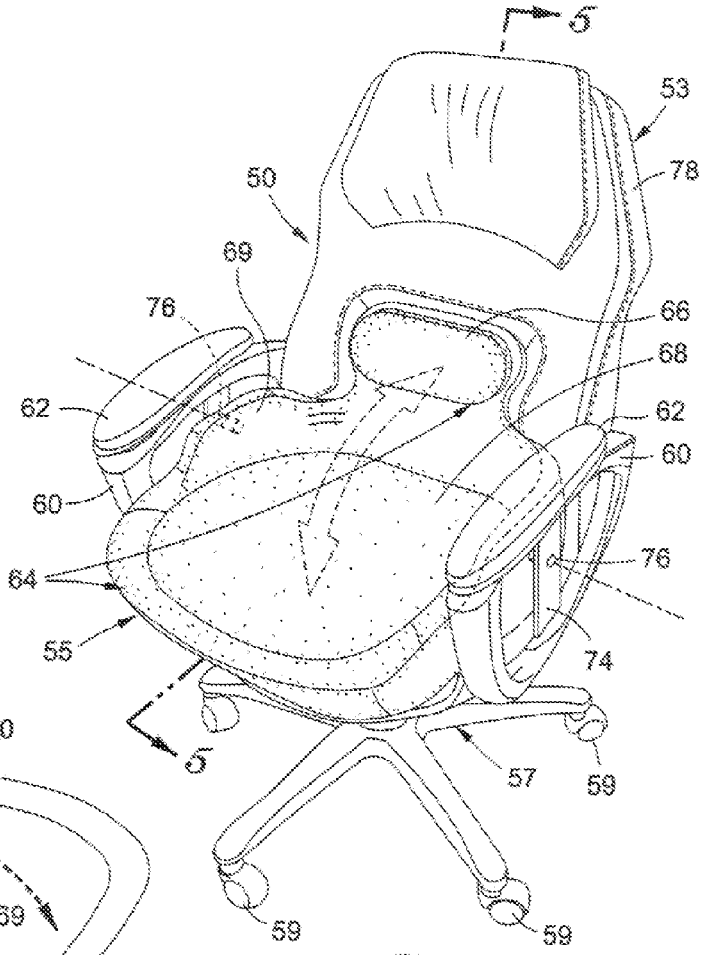
FIG. 4 is a perspective view of a chair having a rotatable seat cradle including pivoting lumbar and seat cushion portions according to a second preferred embodiment.
Figure 5:
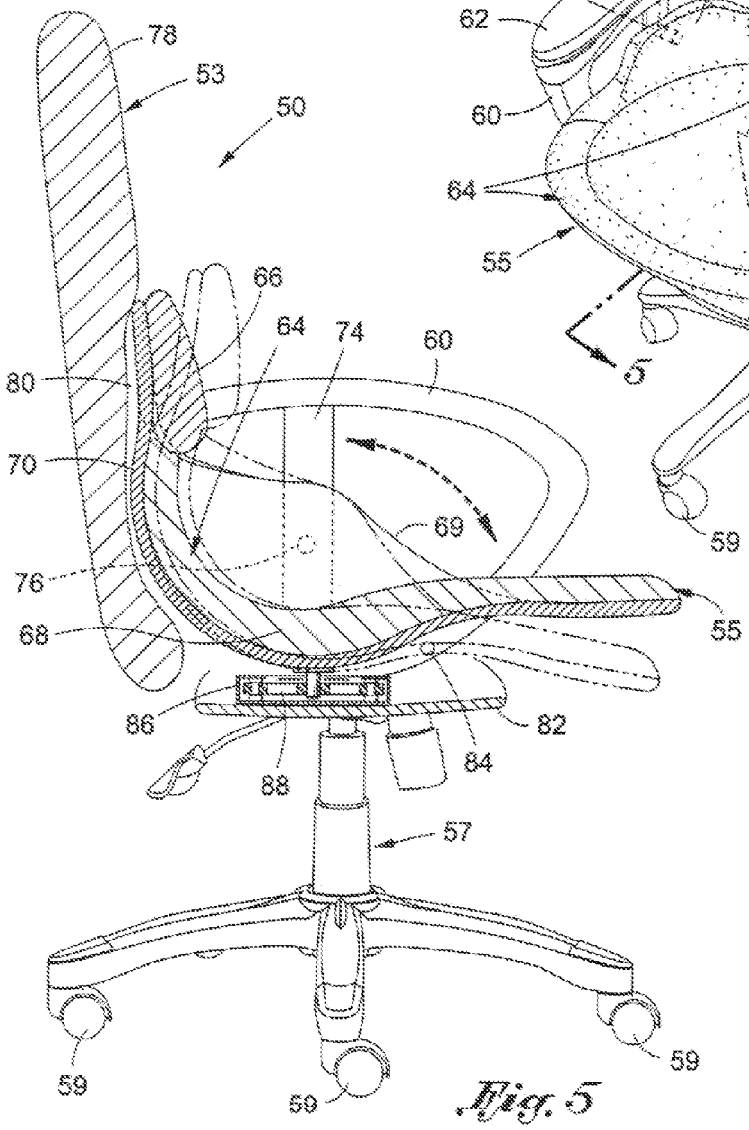
FIG. 5 is a cross-section of the chair taken along lines 5-5 of FIG. 4.

Turning now to FIGS. 4 and 5 of the drawings, there is shown a chair 50 having a rotatable seat cradle including integral pivoting lumbar and seat portions according to a second preferred embodiment of this invention, whereby to improve a user's posture and thereby promote user comfort. Moreover, the user will have the option of performing a modified pelvic tilt exercise when seated. Like the chair 1 of FIGS. 1-3, the chair 50 of FIGS. 4 and 5 includes a back 53 against which the user's back is rested, a seat 55 to support the pelvis of the user, and an adjustable base 57 to elevate the back and seat 53 and 55 above the ground. The base 57 has a set of rollers 59 to enable the chair 50 to be moved from place-to-place. A pair of arms 60 having respective cushion arm pads 62 are located at opposite sides of the chair 50. Each arm 60 is connected to the chair back 53 and to a bracket (designated 82 in FIG. 5) that is mounted atop the chair base 57.

As an important detail of this embodiment, the seat 55 of the chair 50 is a rotatable seat cradle 64 within which to receive and reposition the user's lower back and pelvis. The rotatable cradle 64 includes a lumbar portion 66 located at one end of the cradle and a seat cushion portion 68 located at opposite ends thereof. The cradle 64 also includes a pair of upstanding retaining walls 69 that are located between the lumbar and seat cushion portions 66 and 68 so as to lie adjacent and surround the hips of the user. The lumbar portion 66 and the seat cushion portion 68 of the cradle 64 are co-extensively connected to one another so as to rotate together as a unit through a vertical plane in the direction of the reference arrows of FIGS. 4 and 5 in response to the user shifting his weight forward and back in the chair 50 and rocking in the cradle 64.

The lumbar and seat cushion portions 66 and 68 of the rotatable seat cradle 64 are attached (e.g., adhesively bonded) to a rigid (e.g., molded plastic) backing 70 (best shown in FIG. 5). The backing 70 may be a single continuous piece (as shown) that is bent to conform to the shape of the lumbar and seat cushion portions 66 and 68 or separate pieces that are joined to one another.

A pivot support brace 74 is connected vertically across each of the pair of chair arms 60. Pivots (e.g., pins) 76 extends laterally between the braces 74 attached to the chair arms 60 and opposing ones of the pair of hip surrounding walls 69 which stand upwardly from the rotatable cradle 64. The pivots 76 establish axially-aligned pivot axes around which the cradle 64 can rotate when the user shifts his weight in the chair and rocks in the cradle. It is preferable that the location of the pivots 76 coincides with the hip joint of a user seated in the chair 50. However, the location of the pivots 76 can be adjusted upwardly or downwardly along the vertical pivot support brace 74 and the retaining walls 69.

The back 53 of the chair 50 includes a stationary upstanding back support 78 that extends in a generally vertical direction. A front-facing depression or recess 80 (best shown in FIG. 5) is formed in the back support 78 along approximately the bottom half thereof. The depression 80 is sized and shaped to receive the lumbar portion 66 of the cradle 64 therewithin when the chair 50 is empty and the cradle 64 is centered or a user who is seated within the chair leans back and remains at rest.

A (e.g., steel) bracket 82 (also best shown in FIG. 5) is mounted across the top of the base 57 so as to lie below the seal cushion portion 68 of the seat cradle 64 of the chair 50. Each of the chair arms 60 is connected to the bracket 82 at a mounting hole 84 formed therein. A spring housing 86 is affixed to the bracket 82 of the base 57 so as to lie underneath the rotatable cradle 64. The spring housing 86 encloses a spring member which has a spring memory and is coupled to the cradle 64 so as to bias the cradle to automatically rotate and return to its initial centered position shown in FIG. 5 when the cradle is at rest.

That is, and referring now to FIGS. 6-8 of the drawings, one spring member that is suitable to be enclosed by the spring housing 86 affixed to the bracket 82 below the seat cradle 64 is a cradle restoration block 88 that is manufactured from rubber or any other suitable resilient material with a spring memory. A first stationary spring position limiting post 90 which extends through a first end of the cradle restoration block 88 is attached to a first end of the spring housing 86. A second stationary spring position limiting post 92 which extends through the opposite end of the cradle restoration block 88 is attached to the opposite end of the spring housing 86. A centering rod 94 which extends through the middle of the cradle restoration block 88 at a location between the first and the opposite ends thereof is attached to the bottom of the cradle 64 via an elongated opening formed in the top of the spring housing 86. A first force absorbing space 96 through the cradle restoration block 88 is located between the first end of block 88 which is engaged by the first spring position limiting post 90 and the middle of block 88 which is engaged by the centering rod 94. A second force absorbing space 98 through the cradle restoration block 88 is located between the middle of block 88 and the opposite end thereof which is engaged by the second spring position limiting post 92.

It may thusly be appreciated that the rotatable seat cradle 64 is coupled to the cradle restoration block 88 by means of the centering rod 94. Therefore, as the cradle rotates relative to the back 53, the base 57 and the arms 60 of the chair 50 (of FIG. 5), a corresponding pushing force is applied by the centering rod 94 to the cradle restoration block 88 enclosed by the spring housing 86. The first and second stationary spring positron limiting posts 90 and 92 which extend through opposite ends of the cradle restoration block 88 resist a linear displacement of block 88 through the spring housing 86 in response to the pushing force applied thereto by the rod 94.

Figure 6:
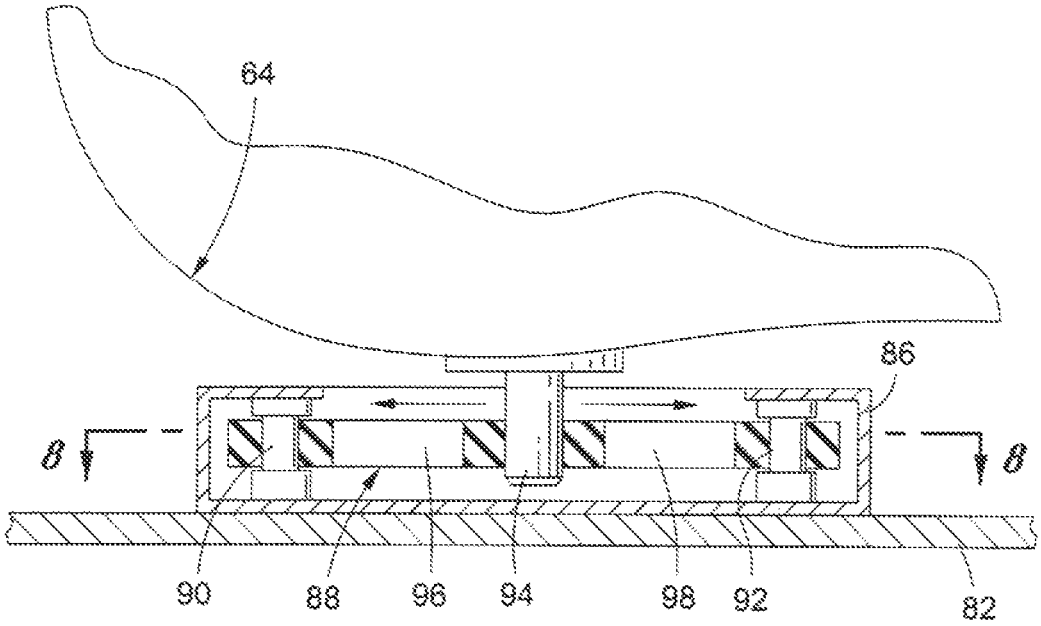
FIG. 6 shows the rotatable seat cradle of the chair of FIG. 4 coupled to a first example of a spring member mounted below the cradle.

When a user is seated in the chair 50 with his weight evenly positioned on opposite sides of the axially aligned pivots 76 (of FIG. 4), the rotatable cradle 46 will be at rest in the manner shown in FIG. 6. Thus, the cradle restoration block (i.e., spring) 88 is relaxed within the spring housing 86 that is carried by the bracket 82. Moreover, the lumbar portion 66 (of FIG. 5) of the rotatable cradle 46 is received within the depression 80 so as to lie against the back support 78 of the chair back 53.

Referring briefly once again to FIGS. 4 and 5, should the user rock in the chair and shift his weight forward of the pivots 76, both the lumbar and seat cushion portions 66 and 68 of the seat cradle 64 will simultaneously rotate in a first direction around the pivots 76. In this case, the lumbar portion 66 rotates away from the back support 78 and out of the depression 80 formed in the back support 78, such that a gap is established between the lumber portion 66 and the back support 78. It may be appreciated that the back support 78 of the chair back 53 remains erect and stationary, such that the lumbar portion 66 of cradle 64 rotates relative to the back support.

At the same time, the seat cushion portion 68 of the cradle 64 which is integrally connected to the lumbar portion 66 rotates downwardly in the first direction around the pivots 76. It may be further appreciated that the seat cushion portion 68 also rotates relative to the stationary back support 78 of the chair back 53.

The positions of the lumbar and seat cushion portions 66 and 68 following the rotation of the seat cradle 64 in the first direction are shown in phantom lines in FIG. 5. When the user rocks backwards in the chair 50 and shifts his weight behind the pivots 76, the cradle 64 will correspondingly rotate in an opposite direction towards the back support 78 so as to return to its initial centered position. In this case, the lumbar portion 66 of the cradle 64 will move back into the depression 80 formed in the back support 78 of the chair back 53.

Figure 7:
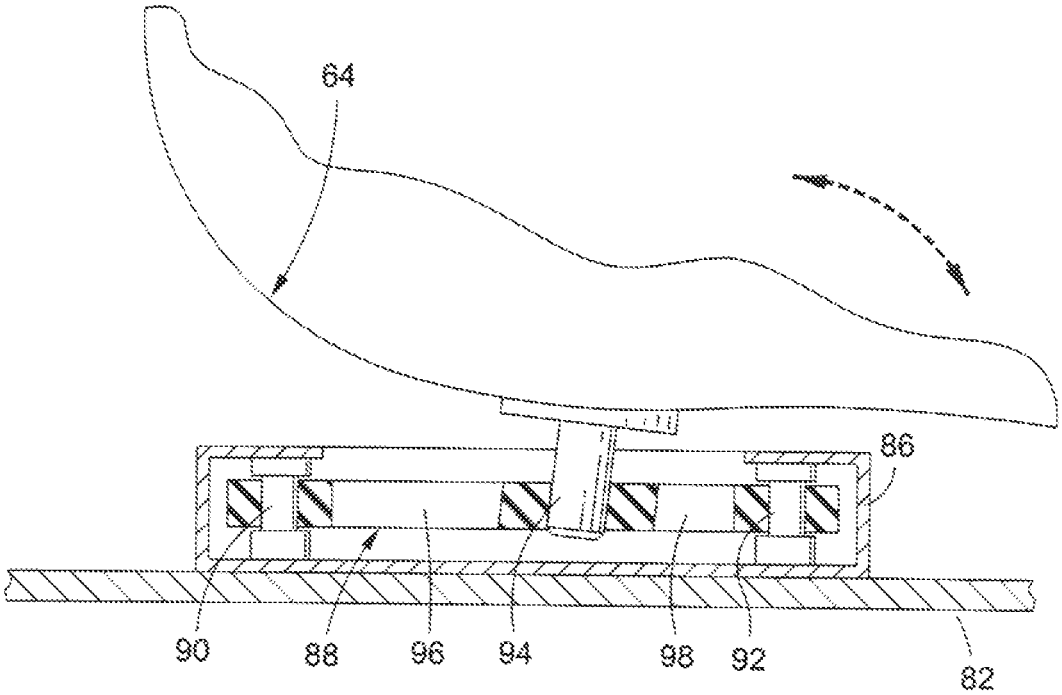
FIG. 7 shows the spring member of FIG. 6 being deformed and compressed as the rotatable seat cradle rotates in a first direction.
Figure 8:
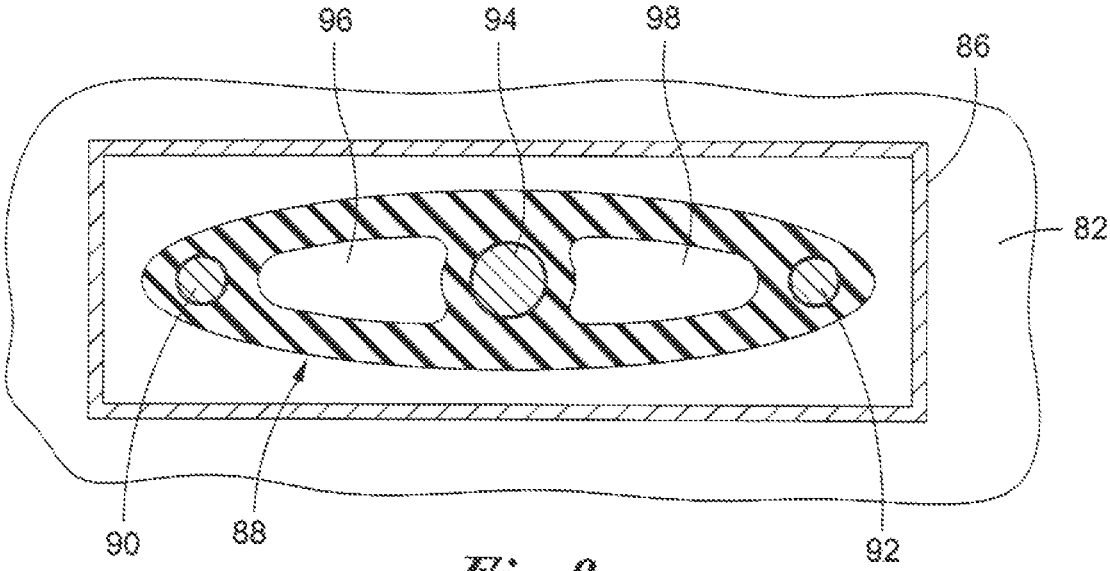
FIG. 8 is a cross-section taken along lines 8-8 of FIG. 6.

Referring concurrently to FIGS. 4-8 of the drawings, as the lumbar and seat cushion portions 66 and 68 of the seat cradle 64 are rotated in the first direction as just described, the centering rod 94 which is attached to the cradle 64 is correspondingly pushed in an opposite direction towards the first spring position limiting post 90 through the cradle restoration block 88 (best shown in FIG. 7). Since the spring position limiting post 90 is stationary within the spring housing 86, the cradle restoration block (i.e., spring) 88 is deformed around the energy absorbing space 96 and compressed between the stationary post 90 and the moving rod 94 such that energy is stored within the block.

When the user leaves the chair 50 or shifts his weight behind the pivots 76, the cradle restoration block 88 will expand and be restored to its original shape so as to release its stored energy. Accordingly, the centering rod 94 is now pushed by the rotating cradle 64 in an opposite direction through the spring housing 86 away from the first spring position limiting post 90 and towards the second spring position limiting post 92. The movement of the centering rod 94 away from the first spring position limiting post 90 causes the cradle 64 to automatically return to its centered at-rest position (of FIG. 6) with the lumbar portion 66 (of FIG. 5) being moved back into the depression 80 formed in the stationary chair back 53.

By virtue of the spring memory of the cradle restoration block 88, the seat cradle 64 of the chair 50 will be biased towards its centered at-rest position (of FIG. 6) in the event that the cradle is over-rotated when the user shifts his weight backwards and the centering rod 94 is correspondingly pushed towards the second spring position limiting post 92 and away from the first spring position limiting post 90. In this case, the cradle restoration block 88 will be deformed around the force absorbing space 98 so as to first store and then release energy as just described to cause the cradle to automatically return to its centered at-rest position.

Figure 9:
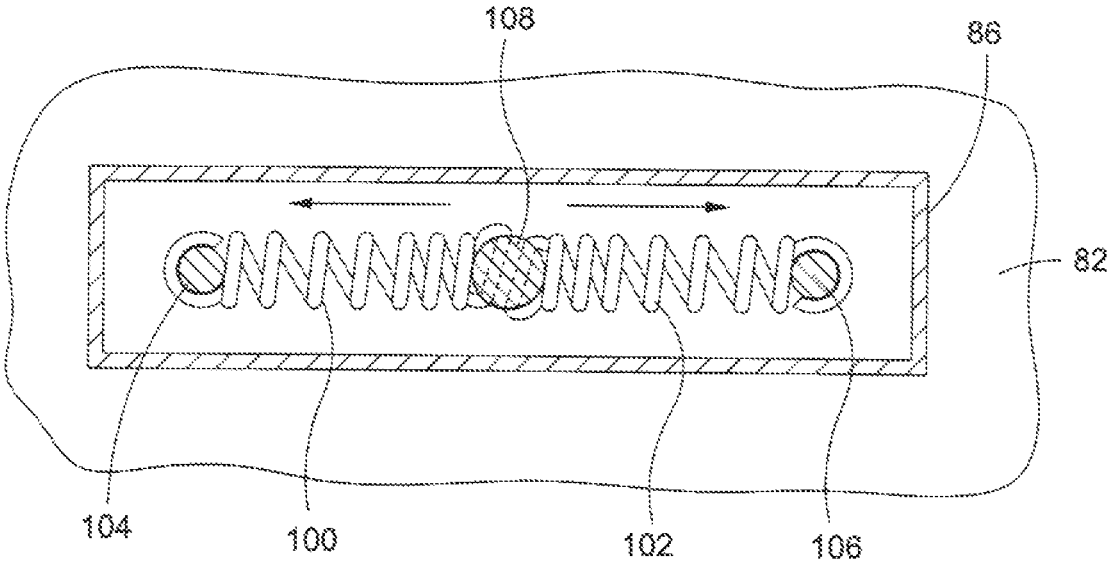
FIG. 9 shows another example of a spring member to which the rotatable seat cradle from the chair of FIG. 4 is coupled.

FIG. 9 of the drawings shows another example of a spring member that is suitable to be enclosed by the spring housing 86 that is affixed to the bracket 82 below the rotatable seat cradle 86. In this case, the spring member is a pair of coil springs 100 and 102 that are axially aligned with one another along the spring housing 86. A first stationary spring position limiting post 104 which extends through a first end of the first spring 100 is attached to a first end of the spring housing 86. A second stationary spring position limiting post 106 which extends through a first end of the second spring 102 is attached to the opposite end of the spring housing 86. A centering rod 108 is attached at one end thereof to the opposite ends of each of the first and second springs 100 and 102. The opposite end of centering rod 108 is attached to the rotatable cradle 64 (not shown), whereby the cradle 64 is coupled to the axially-aligned springs 100 and 102 by means of the centering rod 108.

Thus, any rotation of the seat cradle 64 relative to the bracket 82 and the chair back 53 (of FIG. 5) causes a corresponding pushing force to be applied to one of the spring 100 or 102 depending upon the direction in which the cradle 64 rotates. As in the case of the resilient cradle restoration block 88 of FIGS. 6-8, the centering rod 108 of FIG. 9 moves in a direction which is opposite to the direction in which the cradle 64 rotates. Because the first and second spring position limiting posts 104 and 106 that are connected through first ends of the springs 100 and 102 are stationary, the springs 100 and 102 will be compressed between the moving centering rod 108 and one of the spring position limiting posts when the cradle rotates back and forth as the user shifts his weight in or leaves the chair 50.

In particular, the first spring 100 is compressed to store energy when the user shifts his weight forward in the rotatable cradle 64 away from the back 53 of the chair 50. The spring 100 will expand and release its stored energy when the user shifts his weight back or leaves the chair, whereby to cause the cradle 64 to automatically rotate towards the chair back 53 so as to return to its centered position. The second spring 102 is compressed and expanded in the event the user should overrotate the cradle 64 when he shifts his weight back so as to urge the cradle to return to its centered position.

The invention claimed is:

1. A chair comprising a back, a seat cradle having a seat cushion portion to support the pelvis of a user seated in the chair and a lumbar portion to support the user's lower back, a base located below the seat cradle to hold said seat cradle off the ground, said seat cradle being pivotally connected to said base, and a pair of arms located at opposite sides of said seat cradle, said seat cradle rotating back and forth relative to and independently of said back, said base and said pair of arms when the user shifts his weight in the seat cradle.

2. The chair recited in claim 1, said lumbar portion and said seat cushion portion of said seat cradle being connected to one another so as to rotate together as a unit relative to and independently of said chair back, said base and said pair of arms.

3. The chair recited in claim 1, wherein the lumbar portion and the seat cushion portion of said seat cradle are arranged in perpendicular alignment with respect to one another.

4. The chair recited in claim 1, wherein the back of said chair has a depression formed therein, the chair back remaining stationary and the lumbar portion of said seat cradle moving into and out of said depression as said cradle rotates relative to the stationary chair back when the user shifts his weight in the seat cradle.

5. The chair recited in claim 4, wherein there is a space established between the back of the chair and the lumbar portion of said seat cradle when said cradle rotates and said lumbar portion moves out of the depression formed in said back.

6. The chair recited in claim 2, further comprising a bracket attached to said base below said seat cradle, and at least one coupler projecting from the bottom of said seat cradle, said coupler being pivotally connected to the bracket of said base, whereby said cradle is rotatable relative to and independently of the back, the base and the pair of arms of said chair.

7. The chair recited in claim 6, wherein said pair of arms is fixedly connected to the bracket of said base and to the back of said chair at opposite sides of said seat cradle, said seat cradle rotating at said coupler relative to and independently of the back, the pair of arms and the base of said chair.

8. The chair recited in claim 1, further comprising a backing extending continuously along the lumbar portion and the seat cushion portion of said seat cradle, whereby said lumbar and seat cushion portions are connected to and rotatable with one another relative to and independently of the back, the base, and the pair of arms of said chair.

9. A chair comprising a back, a seat cradle, a base to hold said seat cradle off the ground, and a pair of arms located at opposite sides of said seat cradle, said seat cradle including a lumbar portion located adjacent said chair back to receive and support a user's lower back and a seat cushion portion to receive and support the user's pelvis, said seat cradle being pivotally coupled to the pair of arms so that said seat cradle is rotatable back and forth relative to and independently of said base, said pair of arms and to said back such that said back remains stationary when the user shifts his weight in the seat cradle and the lumbar portion of said cradle moves towards and away from said back.

10. The chair recited in claim 9, wherein the lumbar portion of said seat cradle is co-extensively connected to the seat cushion portion thereof, said lumbar portion located at a first end of said seat cradle and said seat cushion portion located at the opposite end of said cradle, such that said lumbar and seat cushion portions rotate together as a unit as said seat cradle rotates relative to and independently of the back, the base and to the pair of arms of said chair.

11. The chair recited in claim 10, further comprising a backing running along said lumbar portion and said seat cushion portion and extending continuously between the first and opposite ends of said seat cradle.

12. The chair recited in claim 9, wherein said seat cradle also includes a pair of walls located between the lumbar portion and the seat cushion portion thereof so as to surround the hips of the user, said chair further comprising pivots extending between respective ones of the pair of arms of said chair and the pair of walls of said seat cradle, whereby said seat cradle is pivotally connected to said chair arms by means of said pivots so that said cradle is rotatable relative to and independently of said back, said base and said pair of arms.

13. The chair recited in claim 9, further comprising a pivot support interconnected with each of said pair of arms and pivots connected between said seat cradle and each pivot support, whereby said seat cradle is pivotally connected to said pivot supports.

14. The chair recited in claim 9, further comprising a bracket attached to said base below said seat cradle, and at least one coupler projecting from the bottom of said seat cradle, said coupler being mated to the bracket of said base, whereby said seat cradle is rotatable relative to and independently of said base, said back and the pair of arms located at opposite sides of said cradle.

15. The chair recited in claim 9, further comprising a spring support attached to said base, and spring means carried by said spring support and coupled to said seat cradle, said spring means being compressed to store energy when said seat cradle rotates in a first direction relative to the back of said chair in response to the user shifting his weight in said seat cradle away from the chair back, and said spring means expanding and releasing its stored energy to urge the seat cradle to rotate in an opposite direction when the user shifts his weight in said seat cradle towards the chair back.

16. The chair recited in claim 15, further comprising a stationary spring position limiter engaging a first end of said spring means, and a spring rod extending between said seat cradle and said spring means, said spring rod moving towards and away from said stationary spring position limiter so that said spring means is first compressed and then expanded between said stationary spring position limiter and said spring rod in response to said seat cradle rotating in said first and opposite directions.

17. The chair recited in claim 16, further comprising a spring housing mounted on the spring support of said base to enclose said spring means, said stationary spring position limiter located within said spring housing to engage the first end of said spring means and said spring rod moving through said spring housing towards and away from said stationary spring position limiter so that said spring means is compressed and expanded within said spring housing in response to said seat cradle rotating in said first and opposite directions.

18. The chair recited in claim 15, wherein said spring means is a block of resilient material having a spring memory.

19. The chair recited in claim 15, wherein said spring means includes at least one coil spring.

20. The chair recited in claim 15, further comprising a first stationary spring position limiter engaging a first end of said spring means, a second stationary spring position limiter engaging the opposite end of said spring means, and a spring rod extending from said seat cradle to said spring means between the first and opposite ends thereof, said spring rod moving towards and away from one of said first and second stationary spring position limiters depending upon whether said seat cradle rotates in said first or opposite directions so that said spring means is compressed and expanded between said moving spring rod and the one of said first and second stationary spring position limiters.

21. A chair comprising a back, a pair of arms, and a seat cradle positioned between the pair of arms, said seat cradle including a lumbar portion located adjacent said chair back to receive and support a user's lower back and a seat cushion portion integrally connected to said lumbar portion to receive and support the user's pelvis, and pivots extending between respective opposite sides of said seat cradle and corresponding ones of said pair of arms, so that the lumbar and seat cushion portions of said seat cradle are rotatable together at said pivots relative to and independently of said back and said pair of arms, such that the back remains stationary when the lumbar portion of said cradle moves away from and towards said back as the user shifts his weight forward and back in the seat cradle.

22. The chair recited in claim 1, further comprising coupling means located at the bottom of said seat cradle and being pivotally connected to said base, whereby said cradle is rotatable relative to the back, the base and the pair of arms of said chair, said coupling means being the sole means of connecting said seat cradle to any of said back, said base and said pair of arms.

23. The chair recited in claim 9, wherein each of said pair of chair arms is fixedly connected to said base by means of a bracket that extends between said pair of arms and said base and runs below said seat cradle.

* * * * *